US005809906A

United States Patent [19]

Janek

[11] Patent Number: 5,809,906

[45] Date of Patent: Sep. 22, 1998

[54] STRINGERLESS PALLET HAVING ADJUSTABLE DECKBOARDS

[75] Inventor: Nikolas Christian Janek, Aurora, Ohio

[73] Assignee: Chrysler Corporation, Auburn Hills, Mich.

[21] Appl. No.: 695,990

[22] Filed: Aug. 15, 1996

[51] Int. Cl.[6] ..... B65D 19/44

[52] U.S. Cl. ..... 108/57.15; 108/55.1; 108/143

[58] Field of Search ..... 108/51.11, 53.1, 108/55.1, 55.3, 143, 57.15, 57.32; 248/346.02

[56] References Cited

U.S. PATENT DOCUMENTS

| | | | |
|---|---|---|---|
| 3,429,536 | 2/1969 | Petry et al. | 248/346.02 X |
| 3,966,050 | 6/1976 | Dahl | 108/143 X |
| 4,015,710 | 4/1977 | Biggs | 248/346.02 X |
| 4,241,892 | 12/1980 | Morris | 248/346.02 |
| 4,915,033 | 4/1990 | Bond | 108/55.1 |
| 4,977,836 | 12/1990 | Bond | 108/55.1 |
| 5,297,485 | 3/1994 | Bond | 108/55.1 |
| 5,404,821 | 4/1995 | Bond | 108/55.1 |
| 5,533,456 | 7/1996 | Regina | 108/51.1 |

FOREIGN PATENT DOCUMENTS

| | | | |
|---|---|---|---|
| 2255222 | 7/1975 | France | 108/51.1 |
| 1535767 | 1/1990 | U.S.S.R. | 108/51.1 |

*Primary Examiner*—Peter M. Cuomo
*Assistant Examiner*—Janet M. Wilkens

[57] ABSTRACT

A shipping pallet is manufactured from steel plate for the transport of loads which are to be confined on the load-carrying surface without banding the load. The pallet is formed without stringers, instead using a unitized base constructed from multiple sections of channel stock to form a rectangular grid, and welding an imperforate rectangular sheet of steel onto the tops of the channels sections. The sheet of steel reinforces the grid and provides a support surface (deck member) on which locating pins rest. The locating pins are thrust through coaxially aligned perforations in the upper and lower decks of twin-decked deckboards which are slidably adjustable in a pair of C-channels, or, on rails, disposed on opposite sides of the support surface. The locating pins thus confine the load, for example, a stack of sheet metal blanks of arbitrary shape which can be stacked to the height of the locating pins. The adjustable deckboards and multiplicity of perforations therein permit placing locating pins precisely at the periphery of the load, confining it without permitting it movement in the horizontal plane. Through-perforations in the upper and lower surfaces of the deckboards allow locating pins to be inserted so as to rest on the deck member, avoiding the use of detent members to secure the pins in the perforations.

5 Claims, 6 Drawing Sheets

STRINGERLESS PALLET HAVING ADJUSTABLE DECKBOARDS

BACKGROUND OF THE INVENTION

This invention relates to pallets and is particularly concerned with a pallet on which a heavy mass is to be confined so it does not slide on the load-carrying surface of the pallet when it is moved, or under conditions of transportation. The mass is confined on the surface during transportation of the pallet, because acceleration or deceleration of a vehicle carrying the pallet causes the mass to slide. The mass may also slide when the pallet is being loaded onto, or unloaded from the vehicle on which it is transported. The mass may be a single large article such as a coil of steel wire, a skid-mounted compressor, or engine block, or plural articles such as arbitrarily shaped blanks of sheet metal. It is critical that the base of the mass be adequately supported to avoid undue stress on the base which stress would cause distortion of the mass, or damage to the base.

The problem addressed herein is how to capture and closely confine a dispersible load such as a stack of sheet metal blanks, on an indefinitely re-usable pallet, without banding the stack, no matter how different the periphery of one stack is from that of another. Further, substantially the entire area of the load-carrying surface of the pallet is required to be available for positioning a load; the pallet is to be accessible to forks of a forklift truck from either front, back or sideways; and, one pallet is to be stackable upon another.

This invention is specifically related to a stackable re-usable four-way pallet having coaxially aligned perforations for locating pins inserted through unique deckboards which are adjustable and have twin perforated load-carrying upper and lower decks. The locating pins are inserted to confine a single article, or a stack of plural articles, and to avoid banding the stack. Such pallets, sometimes referred to as "pin pallets" are widely used in the automobile industry to transport a stack of sheet metal blanks to a location near a metal-forming press, the pallets being stacked one on top of another without the load of the lower pallet contacting the upper pallet. A pallet currently made by Atlas Technologies of Fenton, Mich., comprises a grid of plural side-by-side rectangular steel tubing sections lying in the directions of the x-axis and y-axis respectively to afford access to forks of a forklift truck. On the upper surface of the grid is welded a perforated sheet of metal, forming the lower of two perforated decks, the upper deck being the one on which the load is carried. There are no deckboards and no stringers Each deck has coaxial, matched, either hexagonal or circular through-apertures. Locating pins are removably inserted in the through-apertures and vertically secured therein with a spring-biased detent in the side of the pin, so that the detent is depressed when pushed through the aperture. The detent bears against the lower surface of the upper deck, keeping the locating pin in the upper aperture. The lower end of a locating pin inserted through the aperture in the lower deck is confined by the thickness of the perforated lower deck, both pin and perforated deck resting on the upper surface of a section of rectangular tubing, maintaining the vertical attitude of the pin. Though the detent in the locating pin holds the pin in the aperture of the upper deck, it fails to prevent the lower end of the pin from being bounced out of the lower aperture during transport. The locating pin therefore does not remain vertical. The apertures in the foraminous decks being fixed, the locations of the pins are not infinitely adjustable. A stack of blanks may have one or more locating pins which fail to contact the periphery of the stack, thus only loosely confine it.

U.S. Pat. No. 5,417,167 to Sadr discloses a lightweight plastic pallet in which the problem was to fix the location of deckboards at any desired location on the stringers to which the load is transferred. There is no concern relative to confining a load on the deckboards which, once located, are not adjustable.

SUMMARY OF THE INVENTION

It is a general object of this invention to provide a pallet comprising a unitary or unitized base formed by welding a reinforcing planar deck of sheet metal onto the top of a channel-formed structure which in turn is the support means for slidably adjustable, twin-decked deckboards with coaxial perforations. The channel-formed structure is a grid formed by sections of rectangular channel, preferably formed from sheet metal stock, which grid forms orthogonally intercommunicating channels. The reinforcing planar deck is welded to the horizontal upper surfaces (top edges) of the sidewalls of at least some of the channel sections. The intercommunicating channel sections provide continuous access channels in the unitized base, which channels not only provide easy access for forks of a fork-lift truck but also allow unrestricted flow of liquid, thus facilitating the cleaning of the pallet. Such a unitized base precludes the use of stringers (the unitized base is hence termed "stringerless"). The load is carried on the upper surface of plural adjustable deckboards provided with through-perforations adapted to receive locating pins which are removably secured therein. Though the deckboards are translatable on track means, the load is not carried by the track means but is transferred to the planar deck through skirts on either side of the deckboards. This unitized base provides a minimally low profile, the planar deck being only slightly above a height required to provide clearance for the thickness of the forks; the lower height, in turn, allows stacking blanks to a greater height in the same volume of space above the deckboards, than in a currently available Atlas pallet.

It is a specific object of this invention to provide a stackable rectangular pallet assembly comprising the aforesaid unitized base welded from sections of channel stock about 10 cm×30.5 cm×10 cm (4"×12"×4", referred to as 4"×12" channel stock) formed from 6.35 mm (0.25") thick pickled and oiled steel plate. A sheet of the steel plate forms the planar deck. On opposed two sides of the deck are secured a pair of track means, in or on which, along the entire length thereof, plural twin-decked deckboards are adjustably disposed along substantially the entire width of the deck. Only the upper surface of the unitized base carries deckboards, the twin decks of which are provided with vertically coaxial through-perforations adapted to receive locating pins slidably inserted there-through and free of detent means, so that the locating pins are supported by the reinforcing planar base member of the unitized base. Locating pins are provided by standard tubing or pipe sections requiring no detents to keep them in the vertical position.

It is another specific object of this invention to provide plural, perforated, hollow, twin-decked deckboards which can be locked to the track means at an optimum position to support a stack of sheet metal blanks because the deckboards are infinitely adjustable above the reinforcing deck member; and, which deckboards can be removed for repair, if necessary, and replaced.

BRIEF DESCRIPTION OF THE DRAWING

The foregoing and additional objects and advantages of the invention will best be understood by reference to the following detailed description, accompanied with schematic illustrations of preferred embodiments of the invention, in which illustrations like reference numerals refer to like elements, and in which.

DETAILED DESCRIPTION OF PREFERRED EMBODIMENTS

In the art, pallet assemblies of this general class, sometimes referred to as "pin-pallets", are used to transport a variety of articles, most commonly, stacks of sheet metal blanks, which are confined on the upper surface of the pallet with peripheral locating pins, so termed because they can be located at the periphery of the stack, typically by insertion in apertures in the load-carrying surface. It is critical that the locating pins be placed at the periphery of the load in such a manner as to permit essentially no movement of the load, that is, less than 1.25 mm (0.5") movement of the load in either the lateral or the transverse directions.

Numerous suggestions for confining a stack of blanks on a pallet have been proffered to date, but none has suggested a pin pallet comprising a unitized base including a channel-formed structure reinforced with a planar deck member carrying track means in or on which twin-decked deckboards are infinitely adjustable and can be locked into any position best adapted to support the load.

Figure 1:
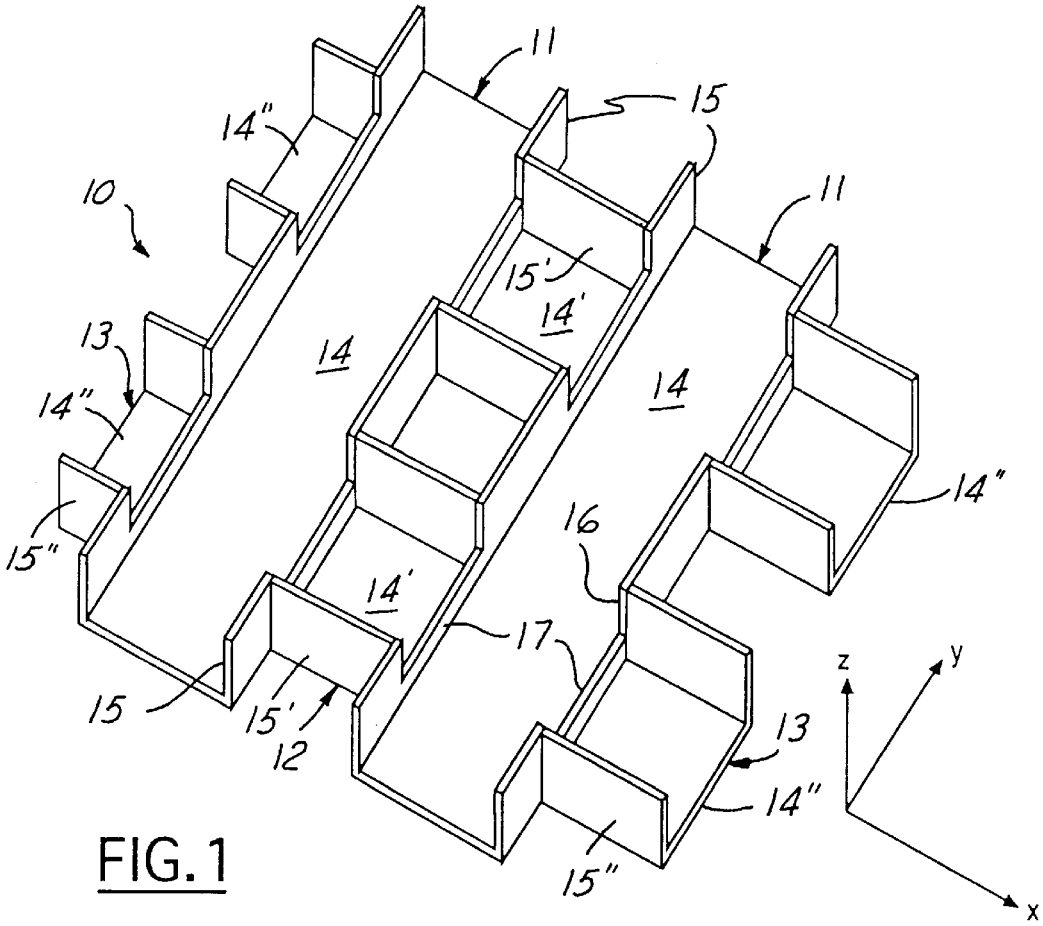
FIG. 1 is an isometric perspective view of a unitized channel-formed base member of the pallet assembly, formed from sections of standard channel having a rectangular cross-sectional profile.
Figure 2:
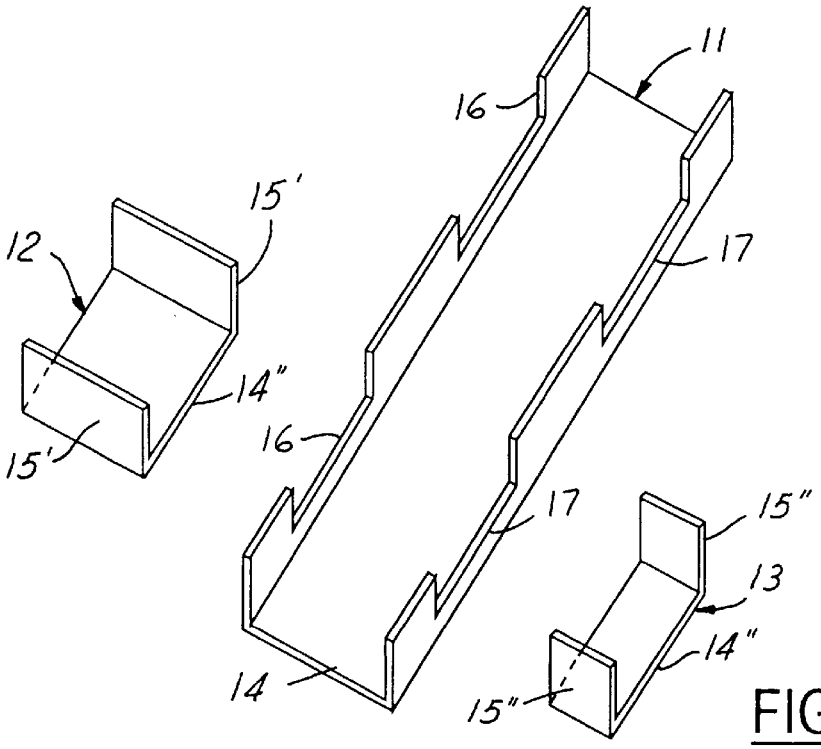
FIG. 2 is an isometric perspective view of the channel elements which are welded together at their respective confronting edges to form a base of orthogonally intercommunicating rectangular channels.

Referring to FIG. 1 there is shown a channel-formed structure 10 formed in a rectangular grid by welding together sections of channel stock 11, 12 and 13 separately shown in FIG. 2, along the vertical edges of their sidewalls. Each section is cut from a chosen rectangular channel stock, the base of which is wider than the width of a fork of a fork-lift truck to be used, and the sidewalls of which are higher than the thickness of the fork. The channel stock is formed from metal plate at least 3.3 mm (0.125") thick, most preferably 6.35 mm (0.25") steel plate, so that sections 11, 12 and 13 have bases 14, 14' and 14" respectively, of the same width. To provide adequate clearance for forks, the sidewalls 15, 15' and 15" are in the range from 15 cm (6") to 40 cm (16") apart, most preferably 30.5 cm (12") apart, and 5 cm (2") to 12.7 cm (5") high, most preferably about 10.2 cm (4") high. The sidewalls of each section are of equal height so that the surfaces of their upper edges are substantially coplanar.

Channel section 11 is provided with at least a pair of transversely spaced-apart rectangular cut-outs 16 the width (along the y-axis) of which corresponds to the width of bases 14' and 14", so that the vertical edges of the walls 15' and 15" can be welded to the sides of the cut-outs 16, along the height of each cut-out. For improved rigidity, each cut-out includes an upstanding ridge 17 which is low enough to avoid interfering with access of a fork into each channel. In the 4"×12" channel the ridge 17 is preferably about 19 mm (0.75") high.

The grid 10, so formed, includes a pair of laterally spaced apart channel sections 11, each having a smoothly planar base 14 open at both front and back ends; and, a pair of transversely spaced apart channel sections each formed by connecting section 12 which is axially aligned with flanking channel sections 13 on the right and left hand sides of the channel sections 11. Each transversely spaced channel section is open at both right and left ends, the transversely extending base of the channel being smoothly planar except for being interrupted by the four ridges 17.

At each corner of the grid 10 is located an upright stacking means or corner-post 18 (see FIG. 3) to stack another pallet assembly. The stacking means comprises a lower corner-post portion 18'(see FIG. 5), closed at its lower end, which is welded into the corner; and an upper corner-post portion 18"which is of the same tubular, preferably rectangular, or square stock as portion 18'. The upper and lower portions 18" and 18' are connected by a square tubular insert 19 which is slidably inserted in lower portion 18'. Upper portion 18" is then slidably positioned over the upper portion of the insert 19. Most preferred for corner-posts is 7.62 cm (3") square tubular steel stock with a 6.35 mm (0.25") wall; and for the insert, 5.6 cm (2.5") square tubular steel stock with a 6.35 mm (0.25") wall.

Figure 3:
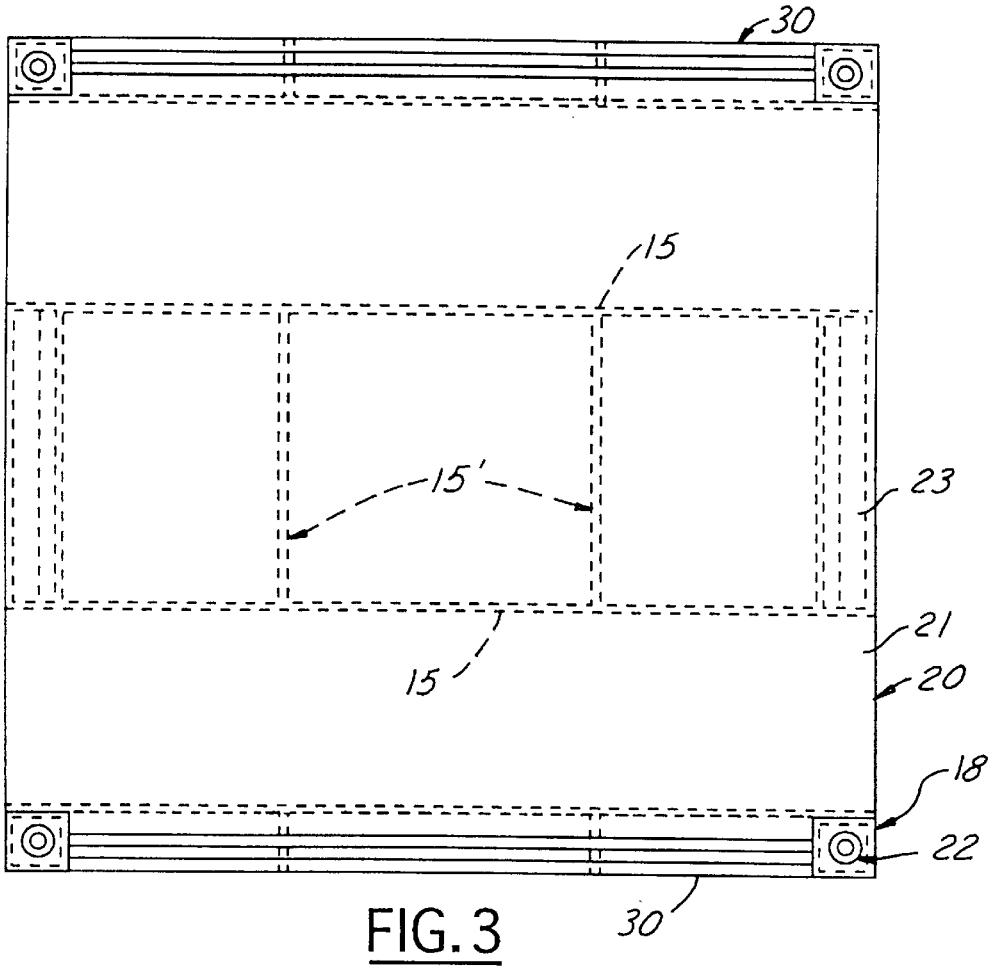
FIG. 3 is a top plan view of the channel-formed unitized base on opposite sides of which a pair of guide rails is secured.
Figure 6:
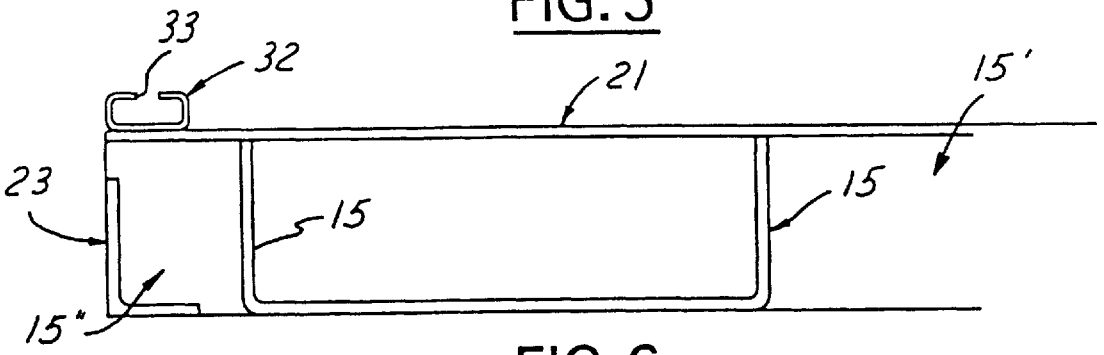
FIG. 6 is a cross-sectional elevational detail across A—A in FIG. 4.

Referring now to FIG. 3 there is presented a plan view of the rectangular pallet assembly without the deckboards to show the unitized base referred to generally by reference numeral 20, with the stacking means 18 at each of the four corners. The unitized base 20 is formed by reinforcing the grid 10 (see FIG. 10) with an imperforate reinforcing metal plate 21 which serves as the deck member. The deck member 21 overlies and is substantially coextensive with the grid, being welded to the upper surfaces of the upstanding walls 15, 15' and 15". The plate is provided with rectangular cut-outs at each of its four corners to allow for corner-posts 18' and 18" (see also FIG. 4) with nesting plugs 22 on which to stack another pallet assembly. As shown in dotted outline, the walls 15 and 15' support the deck member 21. If desired, the grid may be further reinforced with reinforcing members 23 (also see FIG. 6), preferably a piece of 7.62 cm×5 cm (3"×2") angle iron, 6.35 mm (0.25") thick, each welded to the adjacent walls 15 of channel sections 11, and to adjacent walls 15" of channel sections 13, the 4 reinforcing members being positioned across the central transverse and lateral axes, respectively, of the grid.

The track means 30 are carried on opposite sides of the deck member 21, being fastened to the upper surface of the deck member. Preferably, the track means preferably includes a pair of linear solid rails 31 (see FIG. 12), or, C-channel sections 32 (see FIG. 6), each welded at its base to the deck member 21 along the y-axis. Most preferred is a C-channel section secured to the deck with the opening 33 of the C-channel uppermost. Most preferred is a SG-30-A C-channel with a 2 cm (0.75") opening in which a 1.27 cm (0.5") bolt 34 (see FIGS. 4 and 8) is inserted, its head held in the channel.

Figure 4:
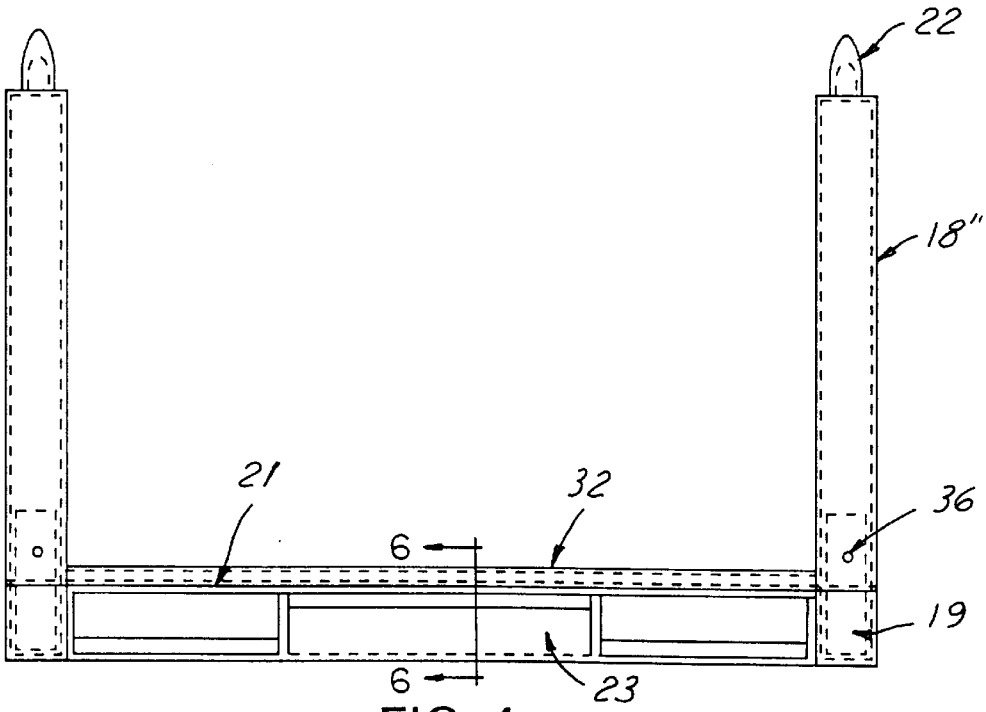
FIG. 4 is a side elevation view of FIG. 3 looking in the direction of the x-axis

Referring to FIG. 4 there is presented a side elevational view of FIG. 3 showing the C-channel 32 welded to deck member 21. The deck member being imperforate provides a continuous planar surface on which locating pins 35 (see FIGS. 8 and 9) are supported. The height of the corner-posts 18" is chosen in relation to the shape of the load to be carried. The corner-posts 18" are provided with apertures 36 through which they are plug-welded to the inserts 19; they are together removably disposed on the lower portion 18' of the corner-post.

Figure 5:
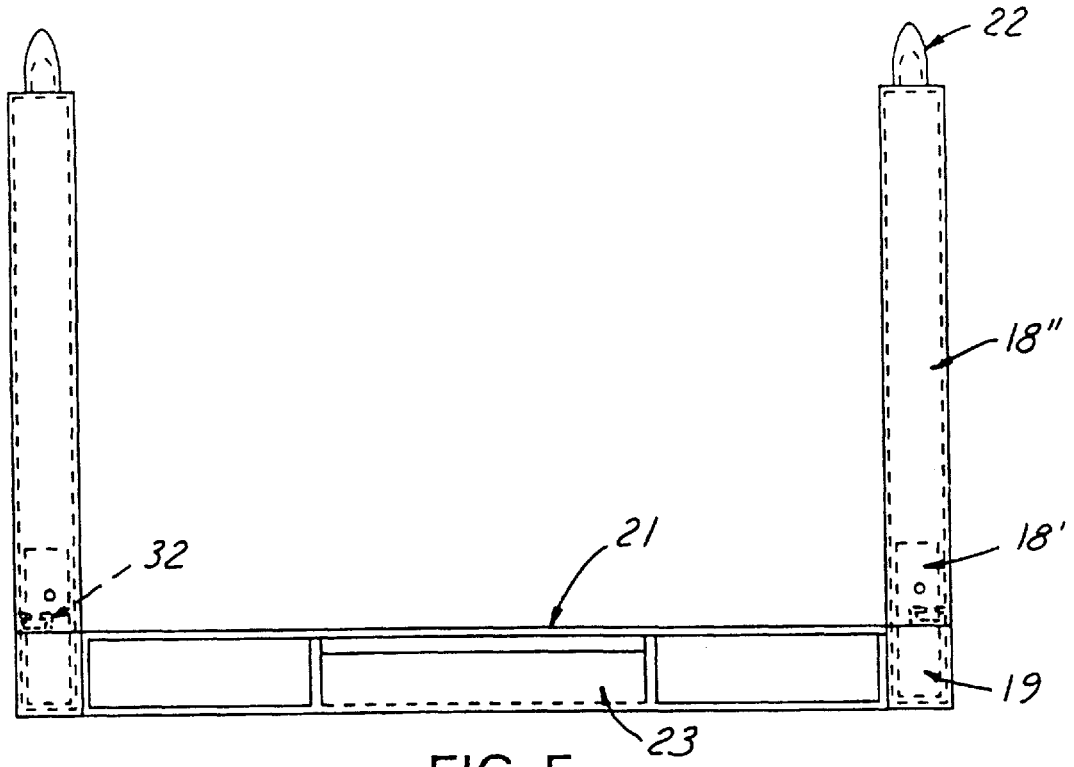
FIG. 5 is a side elevation view of FIG. 3 looking in the direction of the y-axis

Referring to FIG. 5, the front elevational view is substantially the same as that in FIG. 4 because the pallet is square, except that the C-channel is seen in end view because it is taken looking in the direction of the y-axis. It will be evident that the dimensions of the unitized base will be dictated by the size of the load to be carried. Larger loads may require additional channels in either direction, whether along the x-axis or the y-axis, at least two channels being provided along each axis. Thus a unitized base may include an additional channel section 11 welded to the sections 13 of grid 10 and additional sections 13 welded to the newly added section 11. Further, the lateral and transverse dimensions of bases 13' and 14' of sections 13 and 14 of the grid may be the same or different, depending upon the support desired for the load to be carried.

From the foregoing it is evident that the pallet is formed by welding together multiple sections of channel stock along their individual sidewalls to provide a grid with at least two pairs of continuous access channels for forks, one pair orthogonal to the other, then welding an overlying imperforate rectangular sheet with cut-outs at the corners, onto the horizontal coplanar upper surfaces of the sidewalls to reinforce the grid; then, welding a pair of track means on opposed sides of the upper surface of the rectangular sheet.

Figure 7:
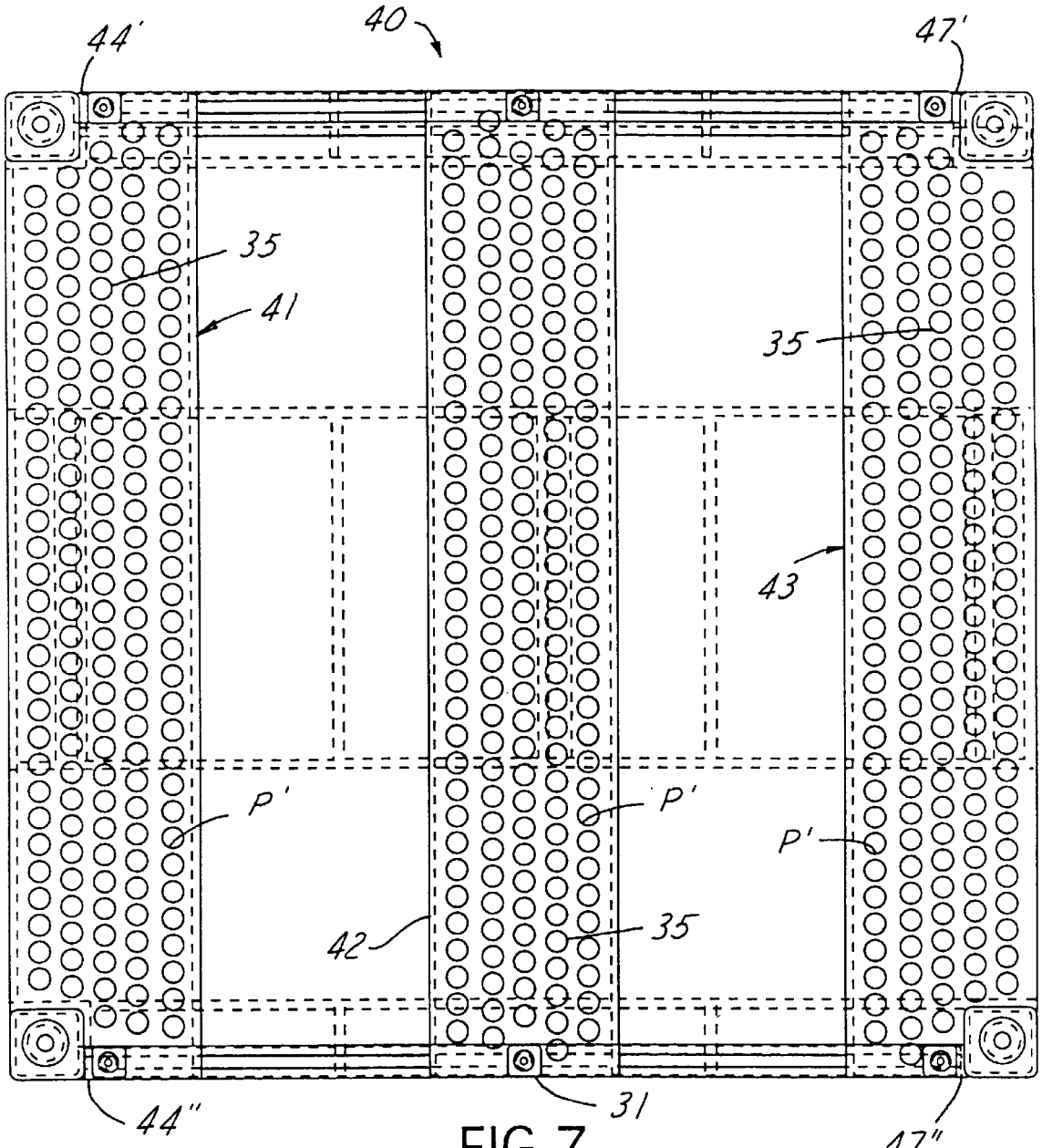
FIG. 7 is a top plan view of a substantially square pallet assembly having three infinitely adjustable deckboards, the side shown (along the x-axis, laterally) in the lower portion of the page being referred to as the front of the pallet; the side (also along the x-axis) shown in the top portion of the page being referred to as the rear or the pallet; and the sides on the left and right hand sides (both sides are along the y-axis, transversely) of the page being referred to as the left and right hand sides of the pallet.

Referring to FIG. 7 there is presented a top plan view of the pallet assembly referred to generally by reference numeral 40 in which the unitized base 20 is provided with three twin-decked deckboards 41, 42 and 43 positioned above and at the left end, center and right end, respectively, of the deck member 21. Each deckboard, translatable in the track means 30, may be slid off one end of the deckboard when the center-posts at that end are removed. This is convenient when a deckboard is to be removed to be repaired or replaced. Locating pins 35 (see also FIGS. 8 and 9) are inserted in aligned perforations P' and P" through both decks of each deckboard, to hold a load of sheet metal blanks at three points on their periphery. The perforations may be circular to hold cylindrical pins, or hexagonal to hold pins with a hexagonal cross-section. More or fewer locating pins may be used, depending upon the shape of the load.

Figure 8:
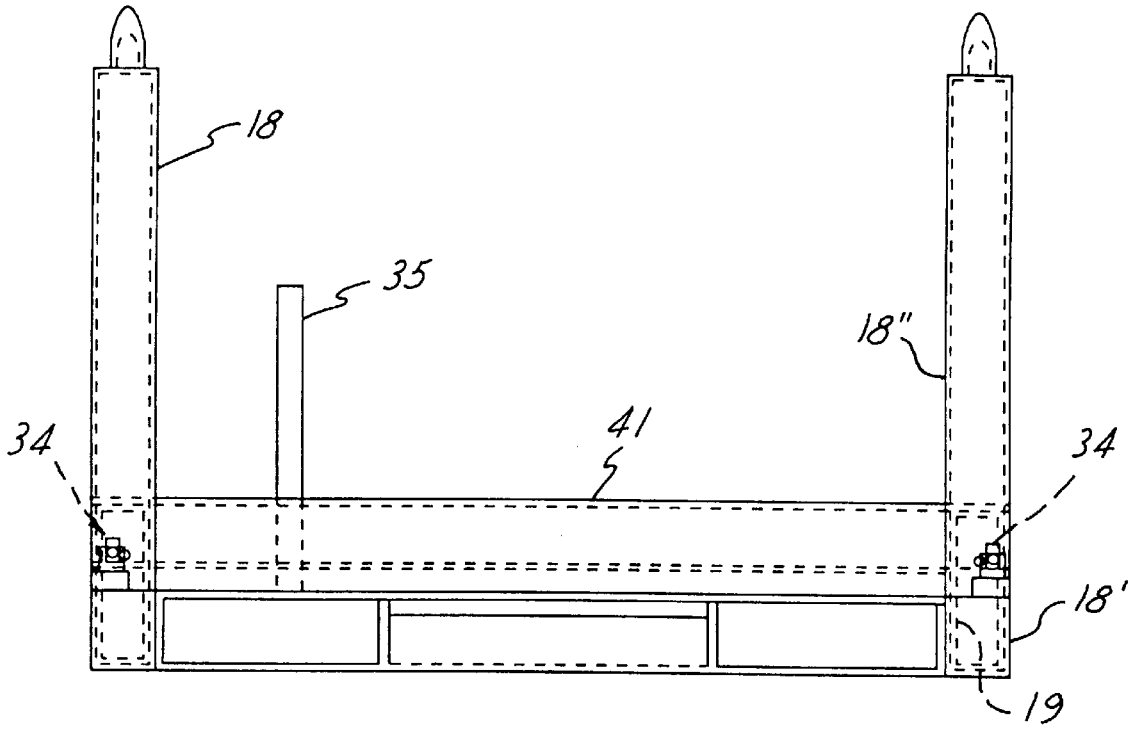
FIG. 8 is a side elevational view as seen from the front of the pallet, the height being along the z-axis (vertically).

Referring to FIG. 8 is a front view of FIG. 7 showing a perforated end-deckboard 41 which is substantially identical with intermediate deckboard 40 except that end-deckboard 41 is preferably provided with rectangular cut-outs 44' and 44" in the corners to accommodate center-posts 18" at those corners; and, end-deckboard 43 is in mirror-image relationship with end-deckboard 41, and provided with rectangular cut-outs 47' and 47" in the corners to accommodate center-posts 18" at those corners. It will be appreciated that the cut-outs 47' and 47" respectively permit perforations P' and P" in the end-deckboards to be located adjacent to and above the opposed edges of the deck member 21, allowing locating pins to be inserted so as to rest near the edges of the deck member, thus utilizing the entire space provided by the deckboard, to confine the load so as to permit essentially no movement of the load in the horizontal plane. Only one of the locating pins 35 is shown inserted through aligned perforations and resting on the deck member 21.

Figure 9:
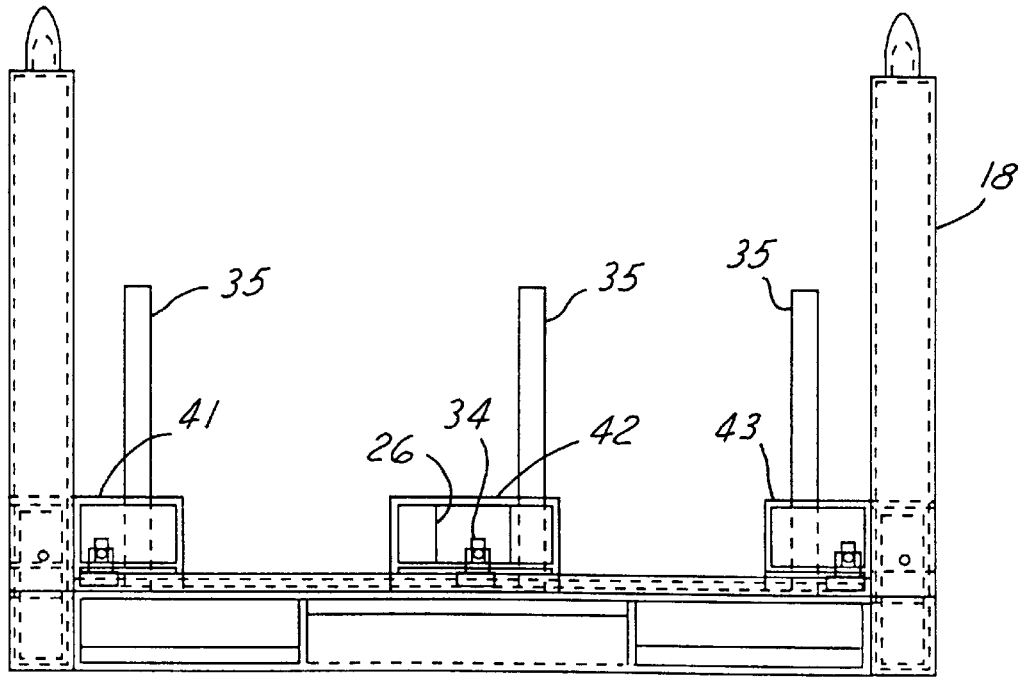
FIG. 9 is a side elevational view as seen from one side of the pallet.

Referring to FIG. 9 is a side elevation view of FIG. 7 showing the three deckboards with a locating pin in each. If desired, plural pins may be used in each deckboard if the periphery of the load would benefit. Additional deckboards 42 may be provided if additional planar support is desired for the base of the load, or if the unitized base 20 is long enough (y-axis in FIG. 1).

Figure 10:
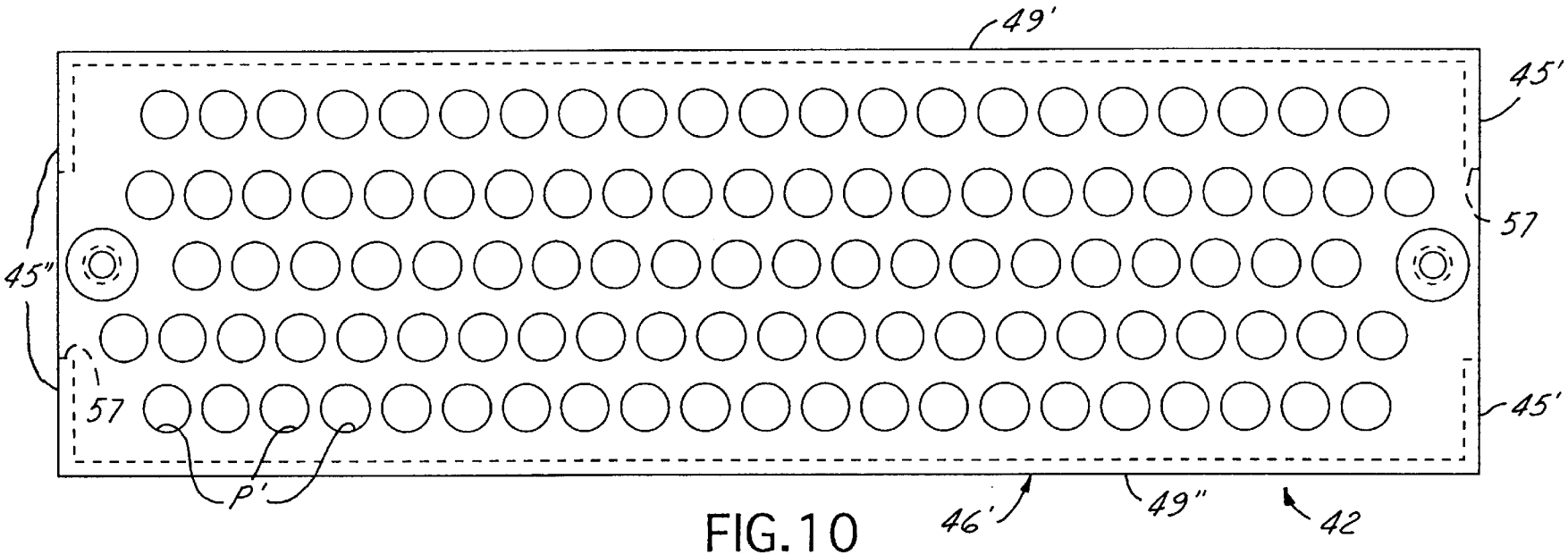
FIG. 10 is a plan view of a twin-decked deckboard having an upper deckboard surface and a lower deckboard surface.
Figure 11:
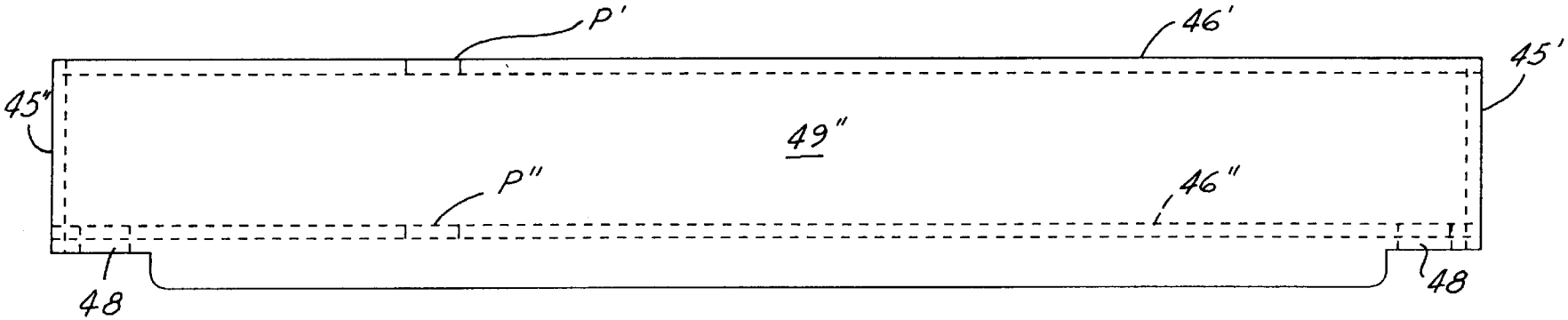
FIG. 11 is a side elevational view of FIG. 10.

In FIGS. 10 and 11 are presented a top plan view and a side elevational view of an intermediate deckboard 42 having an upper deck 46' and a lower deck 46" vertically spaced apart from the upper deck a short distance, preferably in the range from 2.5 cm (1") to about 10 cm (4"), the decks being connected by endwalls 45', 45" and sidewalls 49' and 49", and provided with a multiplicity of coaxial matched perforations P' and P" in the upper and lower decks 46' and 46" respectively. Endwalls 45' and 45" are provided with cut-outs 57 to access the interior of the hollow right prism (parallelpiped) formed. The diameter of each through-passage is such as to allow a locating pin 35 to be slidably inserted through both, so as to rest on the deck member 21. The locating pin 35 may be a section of standard pipe, or rod requiring no detent means to retain the pin in either deck 46' or 46". The lower deck 46" is provided with a through-passage 48 through which a bolt 34 may be inserted to lock the deckboard in position with a cooperating nut (not shown). The lower portions of sides 49' and 49" of the deckboard terminate in skirt portions the lower edges of which abut the upper surface of the deck member 21 to which the load carried by the upper deck of the deckboard is transferred. No substantial portion of the load is therefore carried by the track means which would otherwise be damaged.

A deckboard is preferably constructed as follows: the sides of a perforated rectangular plate 46' are bent down to form skirted sidewalls 49' and 49" within which a perforated plate 46" is located, ensuring that the appropriate height of skirt is obtained, and several locating pins are inserted through the aligned perforations P' and P" before the side edges of plate 46" are welded to the endwalls at their abutting edges. The lower plate is then provided with apertures 48.

End-deckboards 41 and 43 are analogously constructed, and provided with the aforementioned cut-outs. This construction of a deckboard provides an economical and simple way to adjust each anywhere along the track, it being understood that it is not necessary that the end-deckboards be positioned with the cut-outs around the corner-posts.

Though the deckboards 41, 42 and 43 are most preferably formed as hollow elongate, rectangular parallelpipeds or right prisms, from sheet metal, a twin-decked deckboard may also be formed as a solid mass having upper and lower surfaces corresponding to the upper and lower decks. Most preferably, a solid deckboard may be formed from a synthetic resinous material by any conventional means, for example, by rotational molding or injection molding.

Having thus provided a general discussion, described the overall pallet assembly in detail and illustrated it with specific examples of the best mode of making it, it will be evident that the invention has provided an effective solution to a difficult problem. It is therefore to be understood that no undue restrictions are to be imposed by reason of the specific embodiments illustrated and discussed, and particularly that the invention is not restricted to a slavish adherence to the details set forth herein.

I claim:

1. In a stringerless pallet having plural elongate deckboards extending across a unitized base having at least one pair of access channels for forks of a fork-lift truck, and a planar deck member overlying support means of said unitized base, the improvement comprising, said unitized base having an imperforate said planar deck member, track means disposed on said deck member's upper surface which is in vertically spaced apart relationship with each of said deckboards' lower surfaces, said track means serving to allow movement of said deckboards across said deck member, each of said deckboards having an upper deck on which a load is carried, and, a lower deck vertically spaced apart from and beneath said upper deck, positioning means on said deckboards cooperating with said track means to be slidably disposed in relation thereto, and, locking means to lock said positioning means to said track means.

2. The pallet of claim 1 wherein each said deckboard comprises an elongate rectangular body having said upper deck and said lower deck, each having coaxially aligned upper and lower through-perforations therein adapted to receive a locating pin inserted through both said upper and lower through-perforations.

3. The pallet of claim 2 wherein said unitized base comprises a channel-formed structure comprising, plural transverse channel sections lying in the direction of the y-axis, each permitting insertion of a fork of a fork-lift truck, laterally spaced apart to provide insertion of twin forks, plural lateral channel sections lying in the direction of the x-axis, each permitting insertion of a fork of a fork-lift truck, transversely spaced apart to provide insertion of twin forks, each said channel section having sidewalls, the upper horizontal surfaces of which are essentially coplanar, said planar deck member is secured to said upper surfaces to reinforce said channel sections and provide an imperforate support surface.

4. A deckboard for a pallet, said deckboard comprising, an elongate rectangular body having an upper deck and a lower deck, each having coaxially aligned upper and lower through-perforations therein adapted to receive a locating pin inserted through both said upper and lower through-perforations, said lower deck having positioning means adapted to be slidably translatable in relation to track means cooperating with said positioning means.

5. A method for constructing a pallet, comprising, welding together multiple sections of channel stock along their individual sidewalls to form a rectangular grid having at least two pairs of continuous access channels for forks of a fork-lift truck, one pair orthogonal to the other, overlying said grid with an imperforate rectangular sheet having cut-outs at its corners, said cut-outs being adapted to snugly embrace a corner-post, securing a pair of track means to the upper surface of said sheet, along opposed sides thereof, slidably positioning a deckboard in relationship with said track means, and, locking said deckboard to said track means at a selected position.

* * * * *